US008125150B2

(12) United States Patent
Kweon et al.

(10) Patent No.: US 8,125,150 B2
(45) Date of Patent: Feb. 28, 2012

(54) LEAD FREE PLASMA DISPLAY PANEL AND METHOD OF MANUFACTURING THE SAME

(75) Inventors: Tae-Joung Kweon, Suwon-si (KR); Sung-Hune Yoo, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 109 days.

(21) Appl. No.: 12/588,537

(22) Filed: Oct. 19, 2009

(65) Prior Publication Data

US 2010/0096973 A1 Apr. 22, 2010

(30) Foreign Application Priority Data

Oct. 20, 2008 (KR) ..... 10-2008-0102567

(51) Int. Cl.
*H01J 17/49* (2006.01)

(52) U.S. Cl. ..... 313/586; 313/582; 313/587
(58) Field of Classification Search ..... 313/582–587
See application file for complete search history.

(56) References Cited

U.S. PATENT DOCUMENTS 7,795,165 B2 9/2010 Uchiyama et al.
(Continued)

FOREIGN PATENT DOCUMENTS

JP 2001-283733 A 10/2001
(Continued)

OTHER PUBLICATIONS

European Search Report in EP 09173450.9-2208/2178105, dated Nov. 11, 2010 (Kweon et al.), European Search Report from prosecution of corresponding European application.

(Continued)

*Primary Examiner* — Nimeshkumar Patel
*Assistant Examiner* — Jose M Diaz
(74) *Attorney, Agent, or Firm* — Lee & Morse, P.C.

(57) ABSTRACT

A plasma display panel (PDP) including first and second substrates arranged opposite to each other, a plurality of first electrodes between the first and second substrates, a dielectric layer disposed on the first substrate, a plurality of second electrodes disposed in a direction crossing the first electrodes, and red, green, and blue phosphor layers disposed between the first and second substrates, wherein the dielectric layer includes a lead-free glass and at least one of CoO, CuO, $MnO_2$, $Cr_2O_3$, or $Fe_2O_3$ as a metal oxide additive.

14 Claims, 1 Drawing Sheet

U.S. PATENT DOCUMENTS

| | | | | |
|---|---|---|---|---|
| 7,812,526 | B2 * | 10/2010 | Chou et al. | 313/506 |
| 2004/0246204 | A1 * | 12/2004 | Aoki et al. | 345/60 |
| 2005/0231118 | A1 | 10/2005 | Fujimine et al. | |
| 2007/0078047 | A1 | 4/2007 | Tanida et al. | |
| 2008/0233407 | A1 | 9/2008 | Kang et al. | |
| 2010/0109523 | A1 * | 5/2010 | Choi et al. | 313/582 |
| 2010/0133984 | A1 * | 6/2010 | Morioka et al. | 313/485 |
| 2010/0244659 | A1 * | 9/2010 | Takagi et al. | 313/491 |

FOREIGN PATENT DOCUMENTS

| | | | |
|---|---|---|---|
| JP | 2006-282501 | A | 10/2006 |
| JP | 2006-310015 | A | 11/2006 |
| JP | 2006-342018 | A | 12/2006 |
| JP | 2007-176726 | A | 7/2007 |
| JP | 2008-050252 | A | 3/2008 |
| JP | 2008-201596 | A | 9/2008 |
| KR | 10-2004-0080522 | A | 9/2004 |
| KR | 10-2007-0013823 | A | 1/2007 |
| KR | 10-2007-0021720 | A | 2/2007 |
| KR | 10 2007-0103986 | A | 10/2007 |
| WO | WO 2008/015834 | A1 | 2/2008 |
| WO | WO 2008123648 | A1 * | 10/2008 |
| WO | WO 2009066449 | A1 * | 5/2009 |

OTHER PUBLICATIONS

European Office Action in EP 09173450.9-2208, dated Apr. 29, 2011 (Kweon, et al.), European Search Report from prosecution of corresponding European application.

Japanese Office Action in JP 2009-051056, dated Jun. 28, 2011 (Kweon, et al.).

Chinese Office Action dated Aug. 16, 2011. Also attached is an English translation of the Chinese Office Action.

* cited by examiner

LEAD FREE PLASMA DISPLAY PANEL AND METHOD OF MANUFACTURING THE SAME

BACKGROUND OF THE INVENTION

1. Field of the Invention

Embodiments relate to a plasma display panel (PDP) and a method of manufacturing the same. More particularly, the embodiments relate to an environmentally friendly PDP that may avoid the use of lead oxide (PbO).

2. Description of the Related Art

In general, a PDP is a display device that excites a phosphor with ultraviolet (UV) rays produced by discharging a gas, thereby realizing a predetermined image. Since it can have a large screen with high resolution, the PDP is drawing attention as a next generation thin display device. The PDP has a general structure including address electrodes on a rear substrate in one direction and a dielectric layer covering the address electrodes thereon. Then, barrier ribs with a stripe pattern are disposed to correspond to each address electrode on the dielectric layer. The PDP operates by applying an address voltage (Va) between the address electrodes and display electrodes, thereby performing address discharge, and also by applying a sustain voltage (Vs) between a pair of display electrodes, thereby performing sustain discharge.

The Restriction of Hazardous Substances (RoHS) directive will be enforced in the near future. Because the RoHS directive restricts use of six main hazardous materials, e.g., lead (Pb), in all electrical and electronic products, it is necessary to develop a new material that can replace the conventional lead oxide (PbO) for a PDP. $Bi_2O_3$-based and ZnO-based materials are most actively researched as alternatives to PbO.

SUMMARY OF THE INVENTION

Embodiments are therefore directed to a PDP and a method of manufacturing the same.

It is therefore a feature of an embodiment to provide a PDP having high acid and etching resistance, which may not be discolored in a peeling or etching solution.

It is therefore another feature of an embodiment to provide a PDP having suppressed reactivity with an electrode, which may not be discolored as the result of migration of a conductive metal forming the electrode.

At least one of the above features and other advantages may be realized by providing a PDP that includes a first substrate and a second substrate arranged opposite to each other, a plurality of first electrodes disposed between the first and second substrates, a dielectric layer disposed on the first substrate, a plurality of second electrodes disposed in a direction crossing the first electrodes, and red, green, and blue phosphor layers between the first and second substrates, wherein the dielectric layer includes a lead-free glass and at least one of CoO, CuO, $MnO_2$, $Cr_2O_3$, or $Fe_2O_3$ as a metal oxide additive.

The first substrate may be a rear substrate.

The lead-free glass may include at least one of ZnO or $Bi_2O_3$.

The lead-free glass may include $Bi_2O_3$ and the dielectric layer may include the metal oxide additive in a range of about 0.01 parts by weight to about 1.5 parts by weight based on 100 parts by weight of the lead-free glass.

The lead-free glass may include ZnO and the dielectric layer may include the metal oxide additive in a range of about 0.01 parts by weight to about 1.5 parts by weight based on 100 parts by weight of the lead-free glass.

The dielectric layer may further include an alkali metal oxide.

The alkali metal oxide may include at least one of Li, Na, K, Rb, or Cs.

The lead-free glass may include ZnO, and the dielectric layer may include the alkali metal oxide in an amount of about 2 parts by weight to about 7 parts by weight based on 100 parts by weight of the lead-free glass.

The metal oxide additive may be included in an amount of greater than 0 wt % to about 1.5 wt % based on the entire weight of the dielectric material.

The metal oxide additive may be included in an amount of about 0.1 wt % to about 1.1 wt % based on the entire weight of the dielectric material.

The dielectric material may include a metal oxide additive including CuO and CoO in a CuO:CoO weight ratio ranging from about 1:0.1 to about 1:3.

The dielectric material may include a metal oxide additive including CuO, CoO, and $MnO_2$, in which a CuO:CoO weight ratio is about 1:0.1 to about 1:3 and a CuO:$MnO_2$ weight ratio is about 1:0.05 to about 1:1.

The metal oxide additive may have an average particle diameter ranging from about 0.5 μm to about 2.5 μm.

Barrier ribs may be formed on the first substrate, such that the dielectric layer is between the barrier ribs and the first substrate.

At least one of the above features and other advantages may be realized by providing a method of fabricating a PDP, including arranging a first substrate and second substrate to face each other, disposing a plurality of first electrodes between the first and second substrates, forming a dielectric layer disposed on the first substrate, disposing a plurality of second electrodes in a direction crossing the first electrodes, and disposing red, green, and blue phosphor layers between the first and second substrates, wherein the dielectric layer includes a lead-free glass and at least one of CoO, CuO, $MnO_2$, $Cr_2O_3$, or $Fe_2O_3$ as a metal oxide additive.

BRIEF DESCRIPTION OF THE DRAWING

The above and other features and advantages will become more apparent to those of ordinary skill in the art by describing in detail exemplary embodiments with reference to the attached drawing, in which.

DETAILED DESCRIPTION OF THE INVENTION

Figure 1:
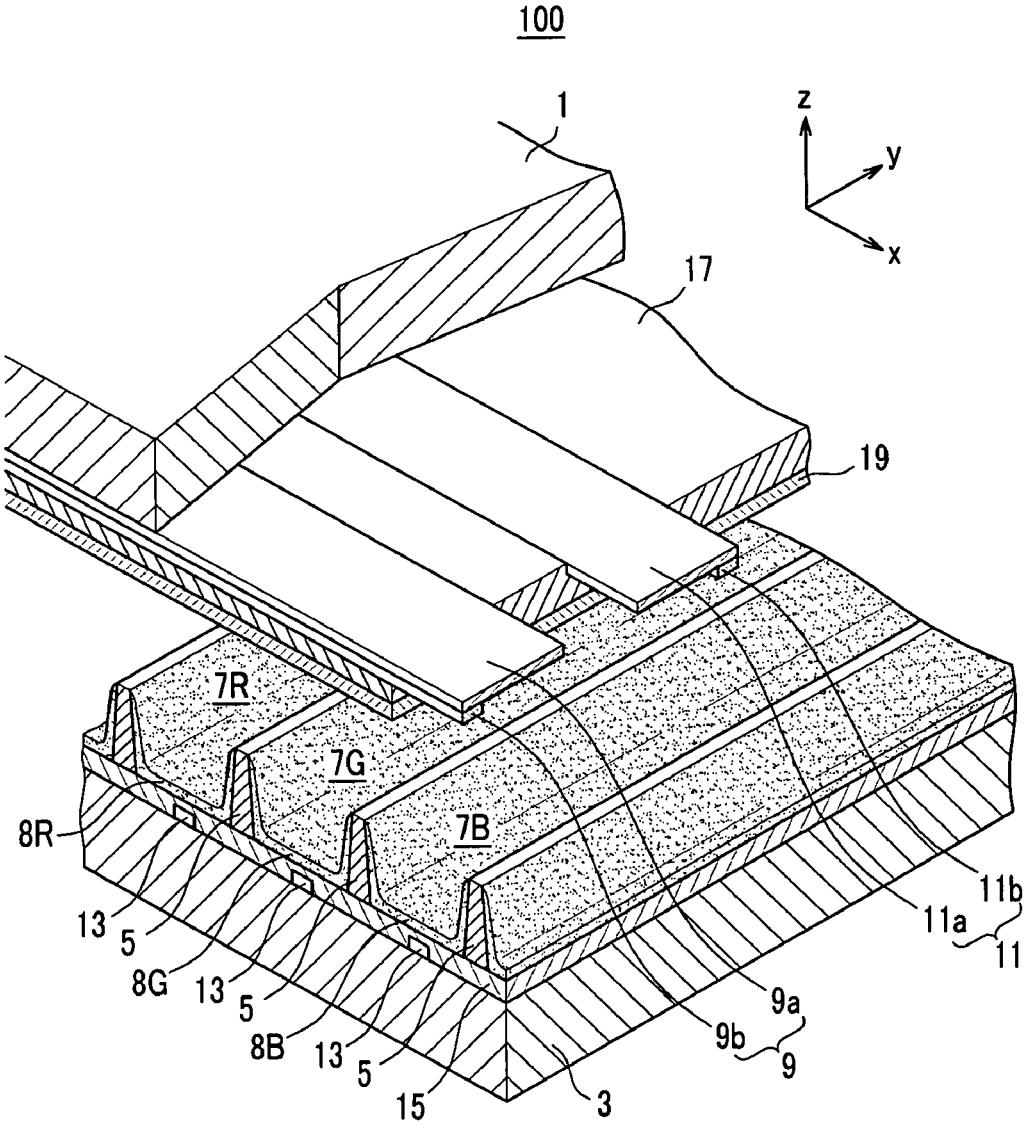
FIG. 1 illustrates an exploded perspective view of a PDP according to an embodiment.

Korean Patent Application No. 10-2008-0102567, filed on Oct. 20, 2008, in the Korean Intellectual Property Office, and entitled: "Plasma Display Panel," is incorporated by reference herein in its entirety.

Example embodiments will now be described more fully hereinafter with reference to the accompanying drawing; however, they may be embodied in different forms and should not be construed as limited to the embodiments set forth herein. Rather, these embodiments are provided so that this disclosure will be thorough and complete, and will fully convey the scope of the invention to those skilled in the art.

In the drawing figure, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present Like reference numerals refer to like elements throughout.

As used herein, the expressions "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" includes the following meanings: A alone; B alone; C alone; both A and B together; both A and C together; both B and C together; and all three of A, B, and C together. Further, these expressions are open-ended, unless expressly designated to the contrary by their combination with the term "consisting of." For example, the expression "at least one of A, B, and C" may also include an $n^{th}$ member, where n is greater than 3, whereas the expression "at least one selected from the group consisting of A, B, and C" does not. As used herein, "lead-free" means RoHS compliant.

FIG. 1 illustrates a partially-exploded perspective view of a PDP 100 according to an embodiment. Referring to FIG. 1, the PDP 100 may include a first substrate 3, a plurality of address electrodes 13 disposed in one direction, e.g., a Y-axis direction on the first substrate 3, and a first dielectric layer 15 disposed on the surface of the first substrate 3 covering the address electrodes 13. Barrier ribs 5 may be formed on the first dielectric layer 15. Red (R), Green (G), and Blue (B) phosphor layers 8R, 8G, and 8B may be respectively disposed in discharge cells 7R, 7G, and 7B formed between the barrier ribs 5.

The first dielectric layer 15 may be a dielectric layer including a lead-free glass and, in particular, may include at least one of ZnO or $Bi_2O_3$, and at least one metal oxide additive of CoO, CuO, $MnO_2$, $Cr_2O_3$, or $Fe_2O_3$ to prevent discoloring of the dielectric layer.

The first dielectric layer 15 may be formed on the first substrate 3 by coating a paste prepared by mixing the lead-free glass and the metal oxide additive with a polymer resin and an organic solvent using a common printing method. Otherwise, the first dielectric layer 15 may be formed by laminating a film formed with the paste on the first substrate 3.

The polymer resin may play a role of a binder. The polymer resin may be any polymer resin that is used to form a dielectric layer. In an implementation, the polymer resin may be at least one of an acryl-based resin, an epoxy-based resin, a cellulose-based resin, and a combination thereof. In still another implementation, the polymer resin may be at least one of ethyl cellulose (EC) or nitro cellulose (NC).

The organic solvent may be any organic solvent that is used to form a dielectric layer. In an implementation, it may be at least one of ethanol, trimethyl pentanediol monoisobutyrate (TPM), butyl carbitol (BC), butyl cellosolve (BC), butyl carbitol acetate (BCA), terpineol (TP), toluene, or texanol.

The barrier ribs 5 may be formed in any shape that can partition the discharge space. In addition, the barrier ribs 5 may have diverse patterns, e.g., an open type such as stripes, or a closed type, e.g., a waffle, a matrix, or a delta shape. Also, the closed-type barrier ribs may be formed in where a horizontal cross-section of the discharge space is a polygon, e.g., a quadrangle, a triangle, a pentagon, a circle, or an oval.

Display electrodes 9 and 11, each including a respective transparent electrode 9*a* and 11*a* and a respective bus electrode 9*b* and 11*b*, may be disposed in a direction crossing the address electrodes 13, e.g., an X-axis direction, on one surface of a second substrate 1 facing the first substrate 3. Also, a second dielectric layer 17 and a protective layer 19 may be disposed on the surface of the second substrate 1 covering the display electrodes. The second dielectric layer 17 and a protective layer 19 may include any material used in this field.

Discharge cells may be formed at the region where the address electrodes 13 of the first substrate 3 cross the display electrodes of the second substrate 1.

In the PDP 100, address discharge may be achieved by applying an address voltage (Va) to a space between the address electrodes 13 and the display electrodes 9 and 11. When a sustain voltage (Vs) is applied to the space between a pair of display electrodes 9 and 11, an excitation source generated from the sustain discharge may excite a corresponding phosphor layer to emit visible light through the second substrate 1 and display an image. Phosphors are usually excited by vacuum ultraviolet (VUV) rays.

According to above-described embodiment, the PDP 100 may include the first and second substrates 3 and 1, respectively, arranged opposite to each other, the plurality of address electrodes 13 disposed on one side of the first substrate 3, the first dielectric layer 15, i.e., the lower dielectric layer, covering the address electrodes 13 thereon, the plurality of display electrodes 9 and 11 disposed in a direction crossing the address electrodes 13 on one side of the second substrate, and red, green, and blue phosphor layers, 8R, 8G, and 8B, respectively disposed between the first and second substrates 3 and 1. The dielectric layer 15 may include the lead-free glass and, as the metal oxide additive, at least one of CoO, CuO, $MnO_2$, $Cr_2O_3$, or $Fe_2O_3$.

The lead-free glass may include at least one of ZnO or $Bi_2O_3$. Since the RoHS directive will be enforced in the near future, research is being actively performed to develop an alternative material that can replace lead oxide (PbO) for a PDP. $Bi_2O_3$-based and ZnO-based lead-free glasses may serve as a replacement.

The lead-free glass may be at least one of zinc oxide-silicon oxide-based ($ZnO—SiO_2$), zinc oxide-boron oxide-silicon oxide-based ($ZnO—B_2O_3—SiO_2$), zinc oxide-boron oxide-silicon oxide-aluminum oxide-based ($ZnO—B_2O_3—SiO_2—Al_2O_3$), zinc oxide-boron oxide-silicon oxide-aluminum oxide-barium oxide-based ($ZnO—B_2O_3—SiO_2—Al_2O_3—BaO$), bismuth oxide-silicon oxide-based ($Bi_2O_3—SiO_2$), bismuth oxide-boron oxide-silicon oxide-based ($Bi_2O_3—B_2O_3—SiO_2$), bismuth oxide-boron oxide-silicon oxide-aluminum oxide-based ($Bi_2O_3—B_2O_3—SiO_2—Al_2O_3$), bismuth oxide-zinc oxide-boron oxide-silicon oxide-based ($Bi_2O_3—ZnO—B_2O_3—SiO_2$), bismuth oxide-zinc oxide-boron oxide-silicon oxide-aluminum oxide-based ($Bi_2O_3—ZnO—B_2O_3—SiO_2—Al_2O_3$), bismuth oxide-boron oxide-silicon oxide-aluminum oxide-barium oxide-based ($Bi_2O_3—B_2O_3—SiO_2—Al_2O_3—BaO$), zinc oxide-boron oxide-aluminum oxide-silicon oxide-phosphorus oxide-based ($ZnO—B_2O_3—Al_2O_3—SiO_2—P_2O_5$), or zinc oxide-barium oxide-boron oxide-bismuth oxide-silicon oxide-aluminum oxide-phosphorus oxide-based ($ZnO—BaO—B_2O_3—Bi_2O_3—SiO_2—Al_2O_3—P_2O_5$).

When a barrier rib etching method is performed, the dielectric layer may also be etched since the ZnO-based lead-free glass material may have low acid resistance and thus, may be very weak against an etching solution. Accordingly, the $Bi_2O_3$-based lead-free glass material may be used in the barrier rib etching method.

In detail, when barrier ribs are formed in an etching method, the dielectric material may be etched, and a barrier rib material may be etched in an etching solution after developing a photoresist in an alkali solution. The dielectric material according to one embodiment, however, includes a $Bi_2O_3$-based composition with strong etching resistance, and accordingly, may not be etched. During this process, however, a hydroxyl group (OH) may be produced on the surface of the dielectric material by an etching solution, e.g., nitric acid, ($HNO_3$).

Next, the photoresist layer may be removed through peeling. Herein, a strong base (alkali) may be used as a peeling solution. The alkali peeling solution may cause reactivity between the hydroxyl group produced on the surface of the dielectric material and the dielectric material. Accordingly, the dielectric material surface may be discolored and even turn into very dark yellow. Like migration of an Ag electrode causing the yellowing phenomenon of the dielectric material, this phenomenon may degrade body color and quality of a panel.

When barrier ribs are formed in an etching method, the metal oxide additive including at least one of CoO, CuO, $MnO_2$, $Cr_2O_3$, $Fe_2O_3$, or a combination thereof, may suppress the yellowing phenomenon of the dielectric material including a $Bi_2O_3$-based lead-free glass material.

Since the $Bi_2O_3$-based lead-free glass material has excellent etching resistance but is very expensive, a ZnO-based lead-free glass material may be used to prepare a dielectric material when a sandblast method is used.

Because the ZnO has a high melting point, the ZnO-based lead-free glass material has a high sintering temperature and thus, may not be fired well. Therefore, an alkali metal oxide with a low melting point may be further included to prepare the dielectric material. The alkali metal oxide may include at least one of Li, Na, K, Rb, or Cs, but is not limited thereto.

Herein, the dielectric layer may include about 2 to about 7 parts by weight of the alkali metal oxide based on 100 parts by weight of ZnO-based lead-free glass. In another embodiment, the dielectric layer may include about 3 to about 6 parts by weight of the alkali metal oxide. When very little alkali metal oxide is included, e.g., less than about 2 parts by weight of an alkali metal oxide based on 100 parts by weight of ZnO-based lead free glass, it may not sufficiently lower the firing temperature of the dielectric layer. On the contrary, when beyond the specified range of the alkali metal oxide is included, e.g., more than about 7 parts by weight of an alkali metal oxide based on 100 parts by weight of ZnO-based lead free glass, it may sharply deteriorate the photo-transmission rate of a dielectric layer. The alkali metal oxide, however, may not need to be included if the dielectric layer can be fired without it.

Components like the alkali metal oxide with small ionization energy may have strong reactivity with an electrode. Accordingly, a dielectric layer that includes the alkali metal oxide may become yellow due to a migration of a conductive metal forming the electrode.

Aside from causing a visual problem by turning the dielectric layer yellow, the migration of the conductive metal may cause a functional problem, i.e. a short circuit between electrodes when the migration continues. Therefore, the dielectric layer according to an embodiment may include the metal oxide additive to suppress reactivity with components, e.g., alkali metal oxide, having small ionization energy. In other words, the metal oxide additive including at least one of CoO, CuO, $MnO_2$, $Cr_2O_3$, or $Fe_2O_3$ may suppress reactivity of a component having small ionization energy with the conductive metal, and thus, may prevent the yellowing phenomenon caused by migration and may prevent occurrence of a short circuit between electrodes.

The metal oxide additive may be included in a non-zero amount of about 1.5 wt % or less based on the entire weight of the dielectric layer. In another embodiment, it may be included in an amount of about 0.1 wt % to about 1.1 wt %. Particularly, when the dielectric layer includes the ZnO-based lead-free glass, it may include the metal oxide additive in an amount of about 0.01 to about 1.5 parts by weight based on 100 parts by weight of the ZnO-based lead-free glass. In addition, when the dielectric layer includes the $Bi_2O_3$-based lead-free glass, it may include the metal oxide additive in an amount of about 0.01 to about 1.5 parts by weight based on 100 parts by weight of the $Bi_2O_3$-based lead-free glass. When the metal oxide additive is included at about 0.01 parts by weight or more based on 100 parts by weight of the $Bi_2O_3$-based lead-free glass, it may not only prevent the $Bi_2O_3$-based lead-free glass material from being discolored by an etching solution, but also effectively prevent the yellowing phenomenon of the ZnO-based lead-free glass material.

In particular, when CoO making the dielectric layer appear blue or CuO making the dielectric layer appear green is included in the dielectric layer, such addition may improve reflection degree and, thereby, improve luminance of a PDP. Herein, the CuO may be included in an amount of about 0.05 wt % to about 0.5 wt % based on the entire weight of the dielectric layer.

The dielectric layer may include a metal oxide additive including CuO and CoO in a weight ratio ranging from about 1:0.1 CuO:CoO to about 1:3 CuO:CoO. When CuO and CoO are included in the above specified range, they may improve reflection degree and further improve luminous efficiency of the panel.

In an implementation, the dielectric layer may include a metal oxide additive including CuO, CoO, and $MnO_2$ in a weight ratio ranging from 1:0.1 to 3:0.05 to 1, i.e., the metal oxide additive may include CuO, CoO, and $MnO_2$, in which the CuO:CoO weight ratio is about 1:0.1 CuO:CoO to about 1:3 CuO:CoO, and in which the CuO:$MnO_2$ weight ratio is about 1:0.05 CuO:$MnO_2$ to about 1:1 CuO:$MnO_2$. When the dielectric layer includes the CuO, CoO, and $MnO_2$ in these weight ratios, it may minimize deterioration of luminous efficiency of a panel and improve its bright room contrast ratio (CR)

The metal oxide additive may have an average particle diameter ranging from about 0.5 μm to about 2.5 μm. When the metal oxide additive has an average particle diameter within the specified range, it may improve manufacturability of the paste and roughness of the dielectric layer while forming a strong barrier rib layer.

The following examples illustrate the embodiments in more detail. However, these are exemplary embodiments and are not limiting.

Fabrication of a Plasma Display Panel (PDP)

Example 1-1

76.4 g of $Bi_2O_3$-based lead-free glass and 2 g of ethyl cellulose as a polymer resin were mixed with 12.6 g of butyl carbitol acetate and 5.4 g of terpineol as an organic solvent. Then, 0.6 g of CuO (particle diameter: 0.5 μm) and 3 g of BYK-306 (BYK Chemie) as a dispersing agent were added to the mixture to prepare a composition for a dielectric layer. Herein, the $Bi_2O_3$-based lead-free glass included 60 wt % of $Bi_2O_3$, 10 wt % of $B_2O_3$, 4 wt % of $SiO_2$, 4 wt % of $Al_2O_3$, 10 wt % of BaO, 0.6 wt % of CuO, and 11.4 wt % of a filler component ($TiO_2$).

The composition for a dielectric layer was coated on the first substrate including an address electrode and fired at 560° C. for 15 minutes, forming a first dielectric layer.

Then, barrier ribs were formed to have a predetermined height and pattern on the first substrate by a common etching method.

In addition, butyl carbitol acetate and terpineol were mixed in a weight ratio of 4:6. 100 parts by weight of this mixed solvent was mixed with 6 parts by weight of ethyl cellulose to prepare a vehicle. Then, 40 parts by weight of $BaMgAl_{10}O_{17}$:Eu as a blue phosphor was mixed with 100 parts by weight of the vehicle to prepare a phosphor paste. The blue phosphor paste was coated at the bottom and sides of discharge cells of the first substrate partitioned with the barrier ribs to form a blue phosphor layer.

Next, using the method described above in reference to forming the blue phosphor layer, red and green phosphor layers were formed by coating $(Y,Gd)BO_3$:Eu as a red phosphor and $ZnSiO_4$:Mn as a green phosphor, respectively.

The first substrate including the phosphor layers was dried at 200° C. and fired at 500° C.

In addition, a second substrate was prepared by forming a second dielectric layer on the substrate including a display electrode, and then forming a protective layer on the second dielectric layer. The first and second substrates were assembled and sealed together. Then, air was evacuated therefrom, and a discharge gas was injected therein. They were aged to fabricate a plasma display panel (PDP).

Example 1-2

A PDP was fabricated according to the same method as Example 1-1 except for adding 0.4 g of CuO.

Example 1-3

A PDP was fabricated according to the same method as Example 1-1 except for adding 0.8 g of CuO.

Example 1-4

A PDP was fabricated according to the same method as Example 1-1 except for substituting CoO for CuO.

Example 1-5

A PDP was fabricated according to the same method as Example 1-4 except for adding 0.4 g of CoO.

Example 1-6

A PDP was fabricated according to the same method as Example 1-4 except for adding 0.2 g of CoO.

Example 1-7

A PDP was fabricated according to the same method as Example 1-1 except for substituting 0.05 g of $MnO_2$ for CuO.

Example 1-8

A PDP was fabricated according to the same method as Example 1-7 except for adding 0.1 g of $MnO_2$.

Example 1-9

A PDP was fabricated according to the same method as Example 1-7 except for adding 0.2 g of $MnO_2$.

Comparative Example 1-1

A PDP was fabricated according to the same method as Example 1-1 except for not using CuO.

Example 2-1

75.4 g of ZnO-based lead-free glass, 2 g of ethyl cellulose as a polymer resin, and 13.3 g of butyl carbitol acetate were mixed with 5.7 g of terpineol as an organic solvent. 0.6 g of CuO (particle diameter: 0.5 μm) and 3 g of a dispersing agent, BYK-306 (BYK Chemie), were add to the mixture to prepare a composition for a dielectric layer. Herein, the ZnO-based lead-free glass included 50 wt % of ZnO, 20 wt % of $B_2O_3$, 3 wt % of $SiO_2$, 3.4 wt % of $Al_2O_3$, 11 wt % of BaO, 0.6 wt % of CuO, and 12 wt % of a filler component ($TiO_2$).

The composition for a dielectric layer was then coated on a first substrate including an address electrode and fired at 565° C. for 15 minutes to prepare a first dielectric layer.

Then, barrier ribs were formed to have a predetermined height and pattern on the first substrate by a common sand-blast method.

In addition, a vehicle was prepared by preparing a mixed solvent of butyl carbitol acetate and terpineol in a weight ratio of 4:6 and adding 6 parts by weight of ethyl cellulose based on 100 parts by weight of the mixed solvent. Then, 40 parts by weight $BaMgAl_{10}O_{17}$:Eu as a blue phosphor was mixed with 100 parts by weight of the vehicle to prepare a phosphor paste. The blue phosphor paste was coated at the bottom and sides of discharge cells of the first substrate partitioned with the barrier ribs to form a blue phosphor layer.

Then, using the method described above in reference to forming the blue phosphor layer, red and green phosphor layers were formed by using $(Y,Gd)BO_3$:Eu as a red phosphor and $ZnSiO_4$:Mn as a green phosphor, respectively.

The first substrate including the phosphor layers was dried 200° C. and fired at 500° C.

In addition, a second substrate was prepared by forming a second dielectric layer on the substrate including a display electrode, and then forming a protective layer thereon. The first and second substrates were assembled and sealed together. Then, air was evacuated therefrom, and discharge gas was injected therein. They were aged to fabricate a PDP.

Example 2-2

A PDP was fabricated according to the same method as Example 2-1 except for adding 0.4 g of CuO.

Example 2-3

A PDP was fabricated according to the same method as Example 2-1 except for adding 0.8 g of CuO.

Example 2-4

A PDP was fabricated according to the same method as Example 2-1 except for substituting CoO for CuO.

Example 2-5

A PDP was fabricated according to the same method as Example 2-4 except for using 0.4 g of CoO.

Example 2-6

A PDP was fabricated according to the same method as Example 2-4 except for using 0.2 g of CoO.

Example 2-7

A PDP was fabricated according to the same method as Example 2-1 except for substituting 0.05 g of $MnO_2$ for CuO.

Example 2-8

A PDP was fabricated according to the same method as Example 2-7 except for using 0.1 g of $MnO_2$.

Example 2-9

A PDP was fabricated according to the same method as Example 2-7 except for using 0.2 g of $MnO_2$.

Comparative Example 2-1

A PDP was fabricated according to the same method as Example 2-1 except for not using CuO.

Measurement of Discoloring Degrees of the Following Dielectric Layers

The PDPs of Examples 1-1 to 1-9 and 2-1 to 2-9, and Comparative Examples 1-1 and 2-1, were measured regarding color coordinates according to the CIE Lab system. A value b* for the each example is shown in the following Tables 1 and 2. The b* value is an index showing color degree of yellow. The higher the b* value is, the more the dielectric layer is discolored. The measurement was performed using CR321 (KONICA MINOLTA) equipment.

based lead-free dielectric material is very expensive even though it has excellent etching resistance, the ZnO-based lead-free dielectric material is deemed to be more appropriate when the barrier ribs are formed by the sandblast method. The ZnO-based lead-free dielectric material, however, has a high melting point and a higher sintering temperature and, thus, may be difficult to fire. Therefore, the alkali metal oxide having a low melting point may be added to the ZnO-based lead-free dielectric material. The alkali metal oxide, however, has higher reactivity with an electrode, and, as a result, may become yellow as the electrode migrates. By adding the metal oxide additive including one or more of CoO, CuO, $MnO_2$, $Cr_2O_3$, or $Fe_2O_3$, reactivity of a component having a small ionization energy with the conductive metal may be suppressed and thus, the yellowing phenomenon caused by migration and occurrence of a short circuit between electrodes may be prevented.

Also, in the case where the barrier ribs are formed by the etching method, the ZnO-based material has very low acid resistance and may be etched into the dielectric layer itself during the barrier rib etching. Accordingly, the $Bi_2O_3$-based lead-free dielectric material may be used when the barrier ribs are formed by the etching method. The $Bi_2O_3$-based lead-free

TABLE 1

| Panel position | Example 1-1 | Example 1-2 | Example 1-3 | Example 1-4 | Example 1-5 | Example 1-6 | Example 1-7 | Example 1-8 | Example 1-9 | Comparative Example 1-1 |
|---|---|---|---|---|---|---|---|---|---|---|
| 1 | 0.6 | 0.9 | 0.2 | 0.3 | 0.7 | 0.2 | 1.4 | 0.6 | 0.3 | 8.1 |
| 2 | 0.4 | 0.8 | 0.2 | 0.4 | 0.8 | 0.1 | 1.5 | 0.7 | 0.4 | 7.8 |
| 3 | 0.5 | 1.0 | 0.3 | 0.3 | 0.6 | 0.1 | 1.4 | 0.6 | 0.3 | 9.1 |
| 4 | 0.5 | 0.9 | 0.1 | 0.4 | 0.6 | 0.2 | 1.6 | 0.7 | 0.5 | 7.5 |
| 5 | 0.6 | 0.9 | 0.1 | 0.4 | 0.7 | 0.1 | 1.5 | 0.7 | 0.4 | 6.8 |
| 6 | 0.4 | 1.1 | 0.3 | 0.5 | 0.8 | 0.2 | 1.4 | 0.8 | 0.3 | 8.5 |
| 7 | 0.6 | 1.1 | 0.3 | 0.3 | 0.8 | 0.1 | 1.6 | 0.6 | 0.4 | 7.4 |
| 8 | 0.5 | 0.9 | 0.2 | 0.3 | 0.7 | 0.1 | 1.6 | 0.7 | 0.3 | 8.2 |
| 9 | 0.6 | 1.2 | 0.2 | 0.4 | 0.6 | 0.2 | 1.3 | 0.8 | 0.5 | 9.3 |
| Avg. | 0.52 | 0.98 | 0.21 | 0.37 | 0.70 | 0.14 | 1.48 | 0.69 | 0.38 | 8.1 |

TABLE 2

| Panel position | Example 2-1 | Example 2-2 | Example 2-3 | Example 2-4 | Example 2-5 | Example 2-6 | Example 2-7 | Example 2-8 | Example 2-9 | Comparative Example 2-1 |
|---|---|---|---|---|---|---|---|---|---|---|
| 1 | 0.4 | 0.8 | 0.1 | 0.3 | 0.5 | 0.1 | 1.1 | 0.5 | 0.2 | 4.1 |
| 2 | 0.5 | 0.7 | 0.1 | 0.4 | 0.4 | 0.0 | 1.2 | 0.6 | 0.3 | 6.2 |
| 3 | 0.5 | 0.9 | 0.1 | 0.3 | 0.5 | 0.1 | 1.2 | 0.5 | 0.3 | 6.3 |
| 4 | 0.4 | 0.8 | 0.0 | 0.4 | 0.6 | 0.0 | 1.3 | 0.6 | 0.3 | 5.7 |
| 5 | 0.5 | 0.9 | 0.2 | 0.3 | 0.5 | 0.0 | 1.1 | 0.5 | 0.2 | 6.5 |
| 6 | 0.5 | 0.9 | 0.1 | 0.4 | 0.6 | 0.1 | 1.3 | 0.4 | 0.2 | 6.1 |
| 7 | 0.4 | 0.7 | 0.1 | 0.2 | 0.4 | 0.1 | 1.3 | 0.6 | 0.4 | 7.2 |
| 8 | 0.4 | 0.8 | 0.2 | 0.4 | 0.5 | 0.0 | 1.2 | 0.5 | 0.2 | 5.5 |
| 9 | 0.3 | 0.7 | 0.1 | 0.3 | 0.5 | 0.1 | 1.2 | 0.4 | 0.2 | 4.6 |
| Avg. | 0.43 | 0.80 | 0.11 | 0.33 | 0.50 | 0.06 | 1.21 | 0.51 | 0.26 | 5.8 |

Referring to Tables 1 and 2, the PDPs of Comparative Examples 1 and 2 had larger b* values than those of Examples 1-1 to 1-9 and 2-1 to 2-9. In other words, the PDPs of Examples 1-1 to 1-9 and 2-1 to 2-9 were not as discolored compared to those of Comparative Examples 1 and 2.

A material for the dielectric layer used as a reflection layer of a rear substrate needs to be designed with a method of forming barrier ribs in mind. When barrier ribs are formed by a sandblast method using an abrasive, a dielectric material should be designed to be suitable for this method. When an etching method is employed, a dielectric material should be designed to be suitable for this method. Since the $Bi_2O_3$- material, however, may have a problem of being discolored in a peeling or etching solution. By adding the metal oxide additive including one or more of CoO, CuO, $MnO_2$, $Cr_2O_3$, or $Fe_2O_3$, the discoloring of the $Bi_2O_3$-based lead-free material in a peeling or etching solution may be prevented.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel (PDP), comprising:

a first substrate and a second substrate arranged opposite to each other;

a plurality of first electrodes between the first and second substrates;

a dielectric layer disposed on the first substrate;

a plurality of second electrodes disposed in a direction crossing the first electrodes; and red, green, and blue phosphor layers between the first and second substrates, wherein the dielectric layer comprises a lead-free glass and CoO, CuO, and $MnO_2$, as a metal oxide additive, in which a CuO:CoO weight ratio is about 1:0.1 to about 1:2 and a CuO:$MnO_2$ weight ratio is about 1:0.05 to about 1:0.4.

2. The PDP of claim 1, wherein the first substrate is a rear substrate.

3. The PDP as claimed in claim 1, wherein the lead-free glass comprises at least one of ZnO or $Bi_2O_3$.

4. The PDP as claimed in claim 3, wherein:

the lead-free glass comprises $Bi_2O_3$, and the dielectric layer comprises the metal oxide additive in a range of about 0.01 parts by weight to about 1.5 parts by weight based on 100 parts by weight of the lead-free glass.

5. The PDP as claimed in claim 3, wherein:

the lead-free glass comprises ZnO, and the dielectric layer comprises the metal oxide additive in a range of about 0.01 parts by weight to about 1.5 parts by weight based on 100 parts by weight of the lead-free glass.

6. The PDP as claimed in claim 3, wherein the dielectric layer further comprises an alkali metal oxide.

7. The PDP as claimed in claim 6, wherein the alkali metal oxide is an alkali metal oxide that comprises at least one of Li, Na, K, Rb, or Cs.

8. The PDP as claimed in claim 6, wherein:

the lead-free glass comprises ZnO, and the dielectric layer comprises the alkali metal oxide in an amount of about 2 parts by weight to about 7 parts by weight based on 100 parts by weight of the lead-free glass.

9. The PDP as claimed in claim 1, wherein the metal oxide additive is included in an amount of greater than 0 wt % to about 1.5 wt % based on the entire weight of the dielectric material.

10. The PDP as claimed in claim 9, wherein the metal oxide additive is included in an amount of about 0.1 wt % to about 1.1 wt % based on the entire weight of the dielectric material.

11. The PDP as claimed in claim 1, wherein the metal oxide additive has an average particle diameter ranging from about 0.5 μm to about 2.5 μm.

12. The PDP as claimed in claim 1, further comprising barrier ribs formed on the first substrate, such that the dielectric layer is between the barrier ribs and the first substrate.

13. A method of manufacturing a plasma display panel (PDP), comprising:

arranging a first substrate and second substrate to face each other;

disposing a plurality of first electrodes between the first and second substrates;

forming a dielectric layer disposed on the first substrate;

disposing a plurality of second electrodes in a direction crossing the first electrodes; and disposing red, green, and blue phosphor layers between the first and second substrates, wherein the dielectric layer comprises a lead-free glass and CoO, CuO, and $MnO_2$, as a metal oxide additive, in which a CuO:CoO weight ratio is about 1:0.1 to about 1:2 and a CuO:$MnO_2$ weight ratio is about 1:0.05 to about 1:0.4.

14. The method of claim 13, wherein the first substrate is a rear substrate.

* * * * *